US010458063B2

(12) United States Patent
Yamazaki et al.

(10) Patent No.: US 10,458,063 B2
(45) Date of Patent: Oct. 29, 2019

(54) CABLE AND METHOD FOR MANUFACTURING CABLE

(71) Applicants: NIPPON STEEL & SUMIKIN ENGINEERING CO., LTD., Tokyo (JP); ALPHA KOGYO K.K., Yokohama-shi, Kanagawa (JP); TOKYO ROPE MFG. CO., LTD., Tokyo (JP)

(72) Inventors: Shinsuke Yamazaki, Tokyo (JP); Yukihiko Oigawa, Yokohama (JP); Fervinia Hipolito Romero, Yokohama (JP); Shinjiro Taniguchi, Yokohama (JP); Yasuyuki Kai, Tokyo (JP)

(73) Assignees: NIPPON STEEL ENGINEERING CO., LTD., Tokyo (JP); ALPHA KOGYO K.K., Yokohama-shi, Kanagawa (JP); TOKYO ROPE MFG, CO., LTD., Tokyo (JP)

( * ) Notice: Subject to any disclaimer, the term of this patent is extended or adjusted under 35 U.S.C. 154(b) by 204 days.

(21) Appl. No.: 15/520,686

(22) PCT Filed: Oct. 22, 2015

(86) PCT No.: PCT/JP2015/079879
§ 371 (c)(1),
(2) Date: Apr. 20, 2017

(87) PCT Pub. No.: WO2016/063960
PCT Pub. Date: Apr. 28, 2016

(65) Prior Publication Data

US 2017/0314195 A1 Nov. 2, 2017

(30) Foreign Application Priority Data

Oct. 22, 2014 (JP) ..... 2014-215174

(51) Int. Cl.
*E04C 5/12* (2006.01)
*D07B 1/06* (2006.01)

(52) U.S. Cl.
CPC ..... *D07B 1/06* (2013.01); *E04C 5/12* (2013.01); *D07B 2201/2046* (2013.01); *D07B 2201/2082* (2013.01); *D07B 2501/203* (2013.01)

(58) Field of Classification Search
CPC ..... E04C 5/12
See application file for complete search history.

(56) References Cited

U.S. PATENT DOCUMENTS 4,121,395 A * 10/1978 Rudolf ..... B29C 70/86 24/122.6
4,367,568 A * 1/1983 Weiser ..... E04C 5/122 24/122.6

(Continued)

FOREIGN PATENT DOCUMENTS

GB 838090 A 6/1960
JP 3-99738 A 4/1991

(Continued)

OTHER PUBLICATIONS

Extended European Search Report, dated May 7, 2018, for corresponding European Application No. 15852062.7.

(Continued)

*Primary Examiner* — Jason W San
(74) *Attorney, Agent, or Firm* — Birch, Stewart, Kolasch & Birch, LLP

(57) ABSTRACT

In a method for manufacturing a cable, a filling step S5 of filling a tube hole of a socket main body which is formed in a tubular shape and in which first end portions of wire rods are disposed with a mixture obtained by mixing a thermo- (Continued)

setting resin into a preliminary mixture obtained by mixing ceramic particles and fly ash in advance is carried out.

8 Claims, 4 Drawing Sheets

(56) References Cited

U.S. PATENT DOCUMENTS 4,442,646 A * 4/1984 Prevedini ..... E04C 5/12 52/223.13
4,448,002 A * 5/1984 Rehm ..... B01J 8/1818 52/223.13
4,501,830 A 2/1985 Miller et al.
4,592,181 A * 6/1986 Matt ..... E04C 5/12 52/223.13
4,619,088 A * 10/1986 Ripoll Garcia-Mansilla ..... E04C 5/12 52/223.13
4,640,068 A * 2/1987 Jungwirth ..... E04C 5/12 24/122.6
4,671,034 A * 6/1987 Rehm ..... E04C 5/12 52/223.13
4,673,309 A * 6/1987 Schlaich ..... E01D 19/14 164/108
RE34,350 E * 6/1993 Dufossez ..... E01D 19/14 52/146
5,345,742 A * 9/1994 Rogowsky ..... E04C 5/12 29/452
5,415,490 A * 5/1995 Flory ..... F16G 11/05 24/122.6
6,061,879 A * 5/2000 Ericson ..... B66B 7/085 24/122.6
6,487,757 B1 * 12/2002 Stubler ..... E01D 19/14 24/115 M
7,942,964 B2 * 5/2011 Luo ..... C04B 20/023 106/644
2004/0159058 A1 * 8/2004 Gulbenkian ..... E01D 19/14 52/223.14
2005/0210782 A1 * 9/2005 Kadotani ..... E04C 5/12 52/223.13
2014/0260034 A1 * 9/2014 Ciuperca ..... E04C 2/296 52/405.3
2015/0137462 A1 * 5/2015 Mellier ..... E01D 19/14 277/634
2015/0247322 A1 * 9/2015 Vincent ..... E04C 5/125 52/223.13
2015/0330077 A1 * 11/2015 Stracke ..... E04H 12/16 52/173.1
2016/0115658 A1 * 4/2016 Annan ..... E04C 5/122 14/21
2018/0222083 A1 * 8/2018 Nagai ..... B28B 11/007
2018/0244983 A1 * 8/2018 Stephens ..... E21B 43/267
2018/0251673 A1 * 9/2018 Beuterbaugh ..... C09K 8/528
2018/0251674 A1 * 9/2018 Nguyen ..... C09K 8/805

FOREIGN PATENT DOCUMENTS

JP 9-209501 A 8/1997
JP 2003-225950 A 8/2003
JP 2005-239788 A 9/2005
WO WO 2013/062534 A1 5/2013
WO WO 2014/192073 A1 12/2014

OTHER PUBLICATIONS

"Semi-Parallel Wire Cable", Shinko Wire Company, Ltd. [online], retrieval date: Sep. 12, 2014, URL:http://www.e-bridge.jp/eb/introacs/pro_80004/summary.php, total 6 pages.
International Search Report for PCT/JP2015/079879 dated Jan. 26, 2016.
Written Opinion of the International Searching Authority for PCT/JP2015/079879 (PCT/ISA/237) dated Jan. 26, 2016.

* cited by examiner

CABLE AND METHOD FOR MANUFACTURING CABLE

TECHNICAL FIELD

The present invention relates to a cable that is used in the sea and the like and a method for manufacturing a cable.

Priority is claimed on Japanese Patent Application No. 2014-215174, filed on Oct. 22, 2014, the content of which is incorporated herein by reference.

BACKGROUND ART

In the related art, a socket having a large outer diameter is provided at the end portion of a cable, thereby facilitating the mounting of the cable to structures and the like. As the above-described type of cables, for example, cables described in Patent Document 1 and Non-Patent Document 1 are known.

In the cable of Patent Document 1, an FRP cable formed by bundling a number of fiber reinforced plastic (FRP) wires (wire rods) is stored in a socket formed in a conical shape so as to have a small diameter at the load end side and a large diameter at the free end side. In this socket, the wires are disposed in a state of being radially dispersed from the load end side toward the free end side. In addition, in the socket, the load end side is filled with a first fastening material (filling material or casting material) that is only made of a thermosetting resin. The free end side of the socket is filled with a second fastening material made of a mixture of a thermosetting resin and a filler.

Examples of the thermosetting resin include epoxy resins, unsaturated epoxy resins, and the like.

As the fillers, for example, steel balls, glass beads, and the like can be used.

Non-Patent Document 1 describes that, as a socket structure for cables, steel balls, zinc powder, and an epoxy resin are cast and hardened.

CITATION LIST

Patent Document

[Patent Document 1] Japanese Unexamined Patent Application, First Publication No. H09-209501

Non-Patent Literature

[Non-Patent Document 1] "Shinko's semi-parallel wire cable SPWC (registered trade name)", [online], [searched on Sep. 12, 2014], internet <URL: http://www.e-bridge.jp/eb/introacs/pro_80004/summary.php>

DISCLOSURE OF INVENTION

Technical Problem

However, regarding the cable of Patent Document 1, in a case in which the FRP wire is applied to a steel wire on which galvanizing is carried out, there is a concern that the attachment performance between the fastening material and the wire may degrade. In addition, the effect of holding the wire using the fastening material is weakened for the above-described reason, and consequently, there is a possibility that the creep resistance will degrade.

In addition, when a metallic material such as metal balls is used as the filling material in the socket as in the cables of Patent Document 1 and Non-Patent Document 1, the corrosion resistance degrades in a case in which seawater, rainwater, or the like enters the socket.

The present invention has been made in consideration of the above-described problems, and an object of the present invention is to provide a cable having improved creep resistance and improved corrosion resistance in case of immersion and a method for manufacturing a cable.

Solution to Problem

In order to solve the above-described problems, this invention proposes the following features.

(1) A method for manufacturing a cable of the present invention, including: a filling step of filling a tube hole of a socket main body which is formed in a tubular shape and in which first end portions of wire rods are disposed with a mixture obtained by mixing a thermosetting resin into a preliminary mixture obtained by mixing ceramic particles and fly ash in advance.

(2) In addition, a cable of the present invention includes a socket main body formed in a tubular shape, wire rods having first end portion disposed in a tube hole of the socket main body, and a filling material which is loaded into the tube hole of the socket main body and is hardened after being mixed with ceramic particles, fly ash, and a thermosetting resin.

According to this invention, since hardening heat of the thermosetting resin is absorbed and diffused by the preliminary mixture obtained by mixing the ceramic particles and the fly ash, the hardening temperature during casting lowers. In addition, since the ceramic particles and the fly ash are not metallic materials, the cable is not easily corroded by seawater or the like.

(3) In addition, the method for manufacturing a cable according to (1), more preferably including, before the filling step: a wire rod insertion step of respectively inserting the first end portions of the wire rods into the tube hole of the socket main body and through holes formed in a fixation plate; and a locking step of locking expanded diameter portions provided at the first end portions of the wire rods to edge portions of the through holes in the fixation plate and separating the first end portions of the wire rods from an inner circumferential surface of the tube hole.

(4) In addition, in the method for manufacturing a cable according to (1) or (3), it is more preferable that, after the filling step, the mixture is hardened so as to produce a filling material, and a second filling material having an elastic modulus that is smaller than an elastic modulus of the filling material is provided on a second end portion side of the wire rods compared with the filling material.

According to this invention, since the second filling material having a small elastic modulus is provided at a portion in which the curvature radii of the wire rods decrease, additional stress in the wire rods at the portion provided with the second filling material diffuses.

(5) In addition, in the method for manufacturing a cable according to any one of (1), (3), and (4), it is more preferable that the thermosetting resin is an epoxy resin.

(6) In addition, in the method for manufacturing a cable according to any one of (1) and (3) to (5), it is more preferable that a ratio of the mass of the ceramic particles to the mass of the fly ash, which are mixed together in the filling step, is 7.0 or more.

(7) In addition, in the method for manufacturing a cable according to any one of (1) and (3) to (6), it is more preferable that a ratio of the sum of the mass of the fly ash and the mass of the ceramic particles to the mass of the thermosetting resin, which are mixed together in the filling step, is 5 or more.

Advantageous Effects of Invention

In the present invention, according to the method for manufacturing a cable according to (1) and the cable according to (2), it is possible to improve creep resistance and corrosion resistance in case of immersion.

According to the method for manufacturing a cable according to (3), it is possible to uniformly load the ceramic particles between the inner circumferential surface of the tube hole of the socket main body and the first end portions of the wire rods.

According to the method for manufacturing a cable according to (4), since stress concentration in the wire rods is relaxed and wear (fretting) between wire rods is relaxed, it is possible to improve the fatigue resistance of wire rods.

According to the method for manufacturing a cable according to (6), it is possible to improve the fluidity of the mixture obtained by mixing the ceramic particles, the fly ash, and the thermosetting resin.

According to the method for manufacturing a cable according to (7), it is possible to prevent the separation of the ceramic particles, the fly ash, and the thermosetting resin which are mixed together.

BEST MODE FOR CARRYING OUT THE INVENTION

Hereinafter, an embodiment of a cable according to the present invention will be described with reference to FIGS. 1 to 7.

Figure 1:
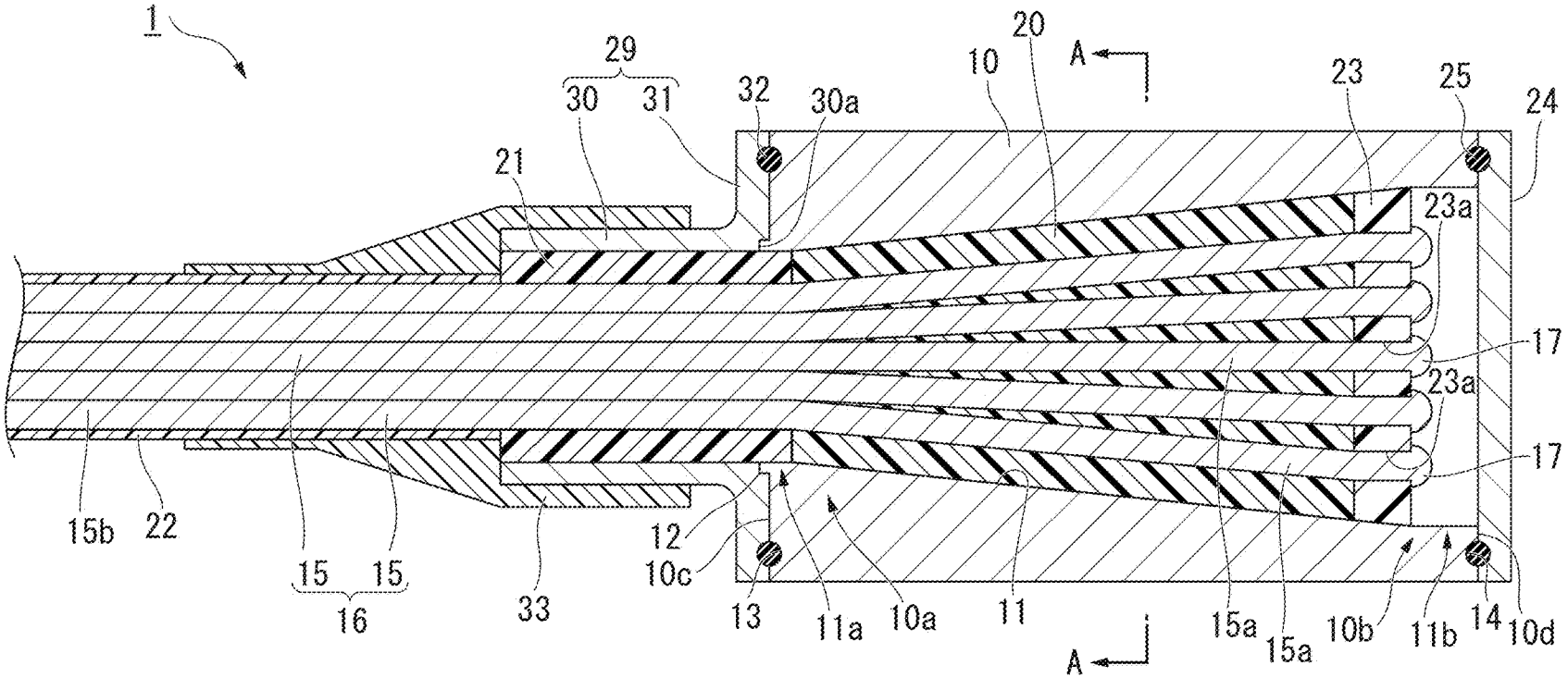
FIG. 1 is a cross-sectional view of a side surface of an end portion in a cable of an embodiment of the present invention.

As shown in FIG. 1, a cable 1 of the present embodiment includes a socket main body 10 formed in a cylindrical shape, a plurality of steel wires (wire rods) 15 having a first end portion 15*a* in a tube hole 11 of the socket main body 10, a first filling material (filling material) 20 loaded into the tube hole 11 of the socket main body 10, and a second filling material 21 provided on a second end portion 15*b* side of the steel wires 15 compared with the first filling material 20.

In the socket main body 10, the inner diameter of the tube hole 11 at a second end portion 10*b* is larger than the inner diameter of the tube hole 11 at a first end portion 10*a*. In more detail, the inner diameter of the tube hole 11 increases toward the second end portion 10*b* from the first end portion 10*a* of the socket main body 10.

At an end of the tube hole 11 on the first end portion 10*a* side, a constant diameter region 11*a* having a constant inner diameter is provided. Similarly, at an end of the tube hole 11 on the second end portion 10*b* side, a constant diameter region 11*b* having a constant inner diameter is provided.

An end surface 10*c* of the socket main body 10 on the first end portion 10*a* side is provided with a protrusion 12 protruding along an edge portion of the tube hole 11. On the end surface 10*c* of the socket main body 10, a ring-shaped groove portion 13 is formed so as to surround the protrusion 12. On an end surface 10*d* of the socket main body 10 on the second end portion 10*b* side, a ring-shaped groove portion 14 is formed so as to surround the tube hole 11.

The outer diameter of the steel wire 15 is, for example, 5 to 7 mm.

A plurality of the steel wires 15 are integrally bundled, thereby constituting a cable main body 16. In the present embodiment, as the cable main body 16, a parallel wire strand (PWS)-type cable is used. A plurality of the steel wires 15 are bundled together using, for example, a coated tube 22 formed of high-density polyethylene.

Each steel wire 15 is a narrow wire rod having a circular horizontal cross-sectional shape. As the steel wire 15, it is possible to employ, for example, a galvanized steel wire or the like which is a steel material having the outer circumferential surface coated with zinc (Zn).

At the first end portion 15*a* of each steel wire 15, a button head (expanded diameter portion) 17 is provided. The button head 17 can be formed by, for example, expanding the diameter of the steel wire 15.

The first end portion 15*a* of each steel wire 15 is inserted into a through hole 23*a* in a fastening plate (fixation plate) 23 formed in a disc shape. The fastening plate 23 is constituted by, for example, cutting out a steel plate in a disc shape.

In the fastening plate 23, a plurality of the through holes 23*a* are formed so as to penetrate in the thickness direction of the fastening plate 23 and separate from each other along the surface of the fastening plate 23.

The button head 17 of the steel wire 15 is locked to an edge portion of the through hole 23*a* in the fastening plate 23. The fastening plate 23 is locked to the socket main body 10 at the end portion of the constant diameter region 11*b* on the first end portion 10*a* side in the tube hole 11 of the socket main body 10.

A lid plate 24 formed in a circular shape is mounted on the end surface 10*d* of the socket main body 10 on the second end portion 10*b* side by screwing tool or the like. A gap between the end surface 10*d* of the socket main body 10 and the lid plate 24 is sealed with a packing 25 disposed in the groove portion 14 of the socket main body 10.

Figure 2:
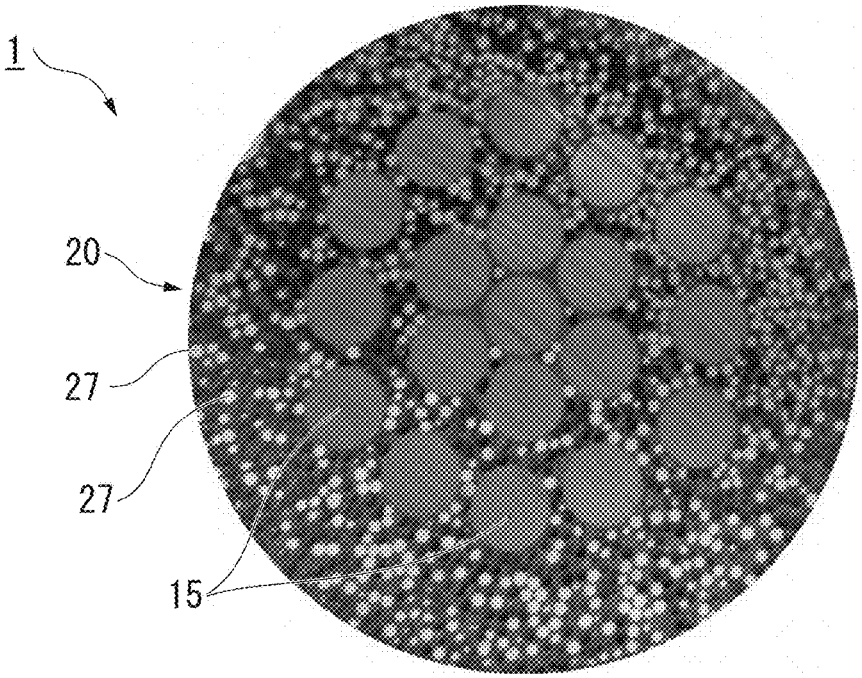
FIG. 2 is a photograph showing a major part of a cross section in the direction of a cutting line A-A in FIG. 1.

The first filling material 20 is a material formed by casting and hardening a mixture obtained by mixing ceramic shots (ceramic particles) 27 as shown in FIG. 2, fly ash (not shown), and an epoxy resin (thermosetting resin).

Meanwhile, FIG. 2 does not show the socket main body 10. During the cutting of the first filling material 20, some of the ceramic shots 27 on the cut surfaces peel off and drop, and the first filling material 20 is dented at portions in which the ceramic shots 27 has dropped. In FIG. 2, the fraction of the ceramic shots 27 in the first filling material 20 is smaller than that in actual cases.

In FIG. 2, the outer diameter of the ceramic shot 27 is, for example, approximately 1 mm. The ceramic shots 27 are, unlike ceramic fibers, shots formed in a particulate shape not in a fibrous shape (shots, non-fibrous particles). The Hv hardness (Vickers hardness) of the ceramic shots 27 is preferably 1,000 HV or more.

In the present embodiment, as the ceramic shots 27, alumina (aluminum oxide) is used, but other materials, for example, zirconia (zirconium dioxide) and the like can be appropriately selected and used. In the first filling material 20, the ceramic shots 27 are uniformly dispersed.

The fly ash refers to, among ashes generated during the combustion of coal, fly ash having a particle diameter small enough to be blown up together with combustion gas.

The first filling material 20 surrounds the respective steel wires 15.

As shown in FIG. 1, a ferrule 29 is mounted on the end surface 10*c* of the socket main body 10 on the first end portion 10*a* side.

The ferrule 29 has a ferrule main body 30 formed in a cylindrical shape and a flange portion 31 provided at the end portion on the outer circumferential surface of the ferrule main body 30. On the inner circumferential surface of the end portion on a side in which the flange portion 31 is provided in the ferrule main body 30, a recess portion 30*a* that is locked to the protrusion 12 of the socket main body 10 is formed. The flange portion 31 of the ferrule 29 is mounted on the socket main body 10 by welding, screwing, or the like. A gap between the end surface 10*c* of the socket main body 10 and the flange portion 31 of the ferrule 29 is sealed with a packing 32 disposed in the groove portion 13 of the socket main body 10.

The second filling material 21 is formed of an epoxy resin having an elastic modulus that is smaller than the elastic modulus of the first filling material 20. The elastic modulus of the second filling material 21 is preferably approximately 1/10 of the elastic modulus of the first filling material 20. The second filling material 21 is disposed between the inner circumferential surface of the ferrule main body 30 of the ferrule 29 and the cable main body 16.

An end portion of the coated tube 22 in the cable main body 16 and the ferrule main body 30 of the ferrule 29 are covered with a tube 33 shrunk (contracted) by exerting heat or the like.

In other words, in the present embodiment, in the cable 1 having the cable main body 16 and the socket main body 20 provided at one end of the cable main body 16, the wire rods 15 of the cable main body 16 are disposed in the tube hole 11 of the socket main body 20. The ferrule 29 is installed at one end of the socket main body 10 in which the tube hole 11 is formed, and the lid plate 24 is installed at the other end of the socket main body 10. The tube hole 11 has a taper portion having a diameter that expands toward the lid plate 24 side from the ferrule 29 side and the constant diameter region 11*a* and the constant diameter region 11*b* which are provided at both ends of the taper portion and have a constant diameter. The wire rods 15 are fixed to the fastening plate 23 provided at the end portion of the taper portion on the lid plate 24 side in the tube hole 11 using the button heads 17. The first filling material 20 is loaded into the taper portion sealed with the fastening plate 23 and the button heads 17 in the tube hole 11 so as to surround each of the wire rods 15 which are bundled toward the ferrule 29 side from the fixation plate 23. The second filling material 21 is loaded from the constant diameter region 11*a* on the ferrule 29 side of the tube hole 11 through the inside of the ferrule 29 so as to surround the bundled wire rods 15.

Figure 3:
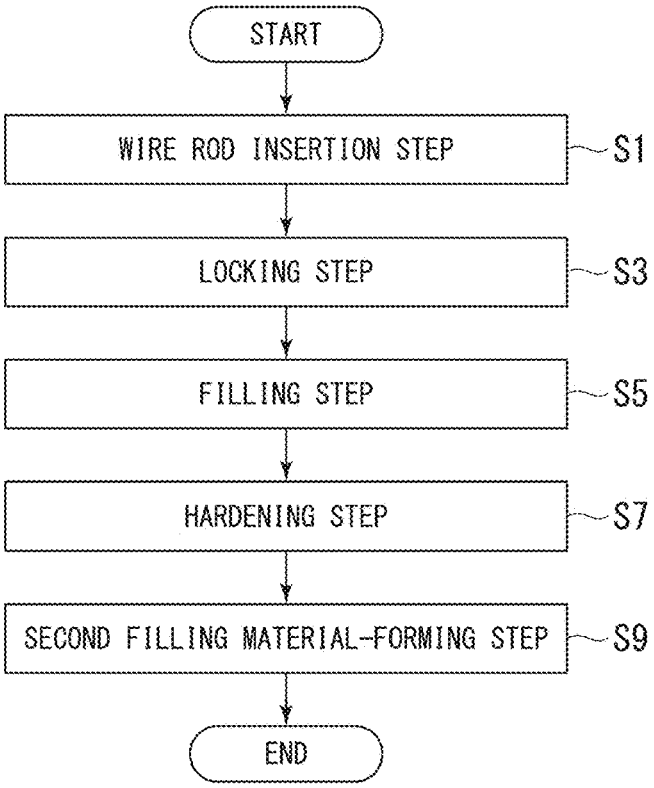
FIG. 3 is a flowchart showing a method for manufacturing a cable of the present embodiment.

Next, a method for manufacturing the cable 1 of the present embodiment which is used to manufacture the cable 1 constituted as described above will be described. FIG. 3 is a flowchart showing the method for manufacturing the cable 1 of the present embodiment.

Figure 4:
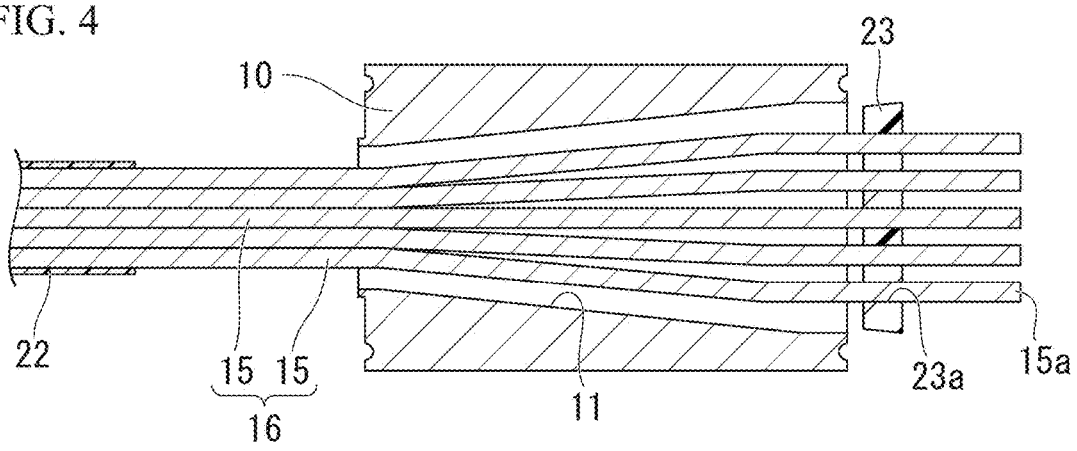
FIG. 4 is a cross-sectional view showing the method for manufacturing a cable of the present embodiment.

First, in a wire rod insertion step S1 (refer to FIG. 3), the cable main body 16 is cut into a predetermined length as shown in FIG. 4, and the coated tube 22 at the end portion of the cable main body 16 is removed. The first end portions 15*a* of the steel wires 15 in the cable main body 16 from which the coated tube 22 has been removed are respectively inserted into the tube hole 11 of the socket main body 10 and the through holes 23*a* formed in the fastening plate 23.

Figure 5:
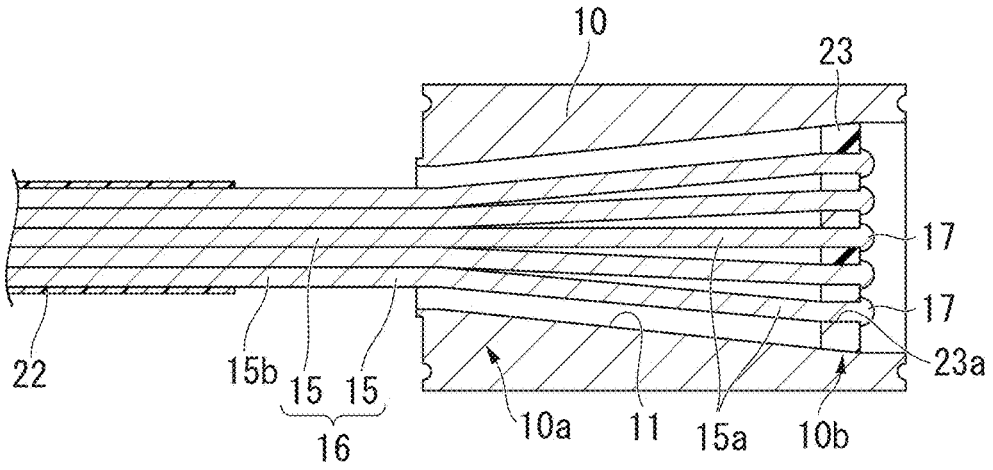
FIG. 5 is a cross-sectional view showing the method for manufacturing a cable of the present embodiment.

Next, in a locking step S3, the button heads 17 are formed at the first end portions 15*a* of the steel wires 15 as shown in FIG. 5. The button head 17 of the steel wires 15 are locked to the edge portions of the through holes 23*a* in the fastening plate 23, and the first end portions 15*a* of the steel wires 15 are separated from the inner circumferential surface of the tube hole 11 of the socket main body 10.

Next, in a filling step S5, the ceramic shots 27 and the fly ash are mixed together using a well-known mixer, thereby producing a preliminary mixture.

The ratio of the mass of the ceramic shots 27 to the mass of the fly ash in the preliminary mixture (the mass ratio of the ceramic shots 27 in a case in which the mass of the fly ash is set to one; hereinafter, referred to as the ceramic mass ratio) is preferably approximately 7 or more and more preferably 7.2 or more. The ceramic mass ratio is still more preferably 7.0 to 9.0 and most preferably 7.2 to 8.5.

In addition, an epoxy resin which is yet to be hardened is mixed into this preliminary mixture, thereby producing a mixture (mixture 20A). The ratio of the sum of the mass of the fly ash and the mass of the ceramic shots 27 to the mass of the epoxy resin (the ratio of the total mass of the fly ash and the ceramic shots 27 in a case in which the mass of the epoxy resin is set to one; hereinafter, referred to as the aggregate mass ratio) is preferably 5 or more. The aggregate mass ratio is more preferably 5.0 to 6.5 and still more preferably 5.5 to 6.0.

Meanwhile, when the ceramic mass ratio is set to 7, and the aggregate mass ratio is set to 5.5, the ratio among the mass of the ceramic shots 27, the mass of the fly ash, and the mass of the epoxy resin becomes 77:11:16. That is, in the ratio among the mass of the ceramic shots 27, the mass of the fly ash, and the mass of the epoxy resin, the mass of the ceramic shots 27 is greatest, and the mass of the fly ash and the mass of the epoxy resin are almost identical to each other.

The mixture may further include a silane coupling material, and the mass percentage of the silane coupling material with respect to the total amount of the mixture is preferably 0.07% to 4% and more preferably 0.07% to 0.7%.

Figure 6:
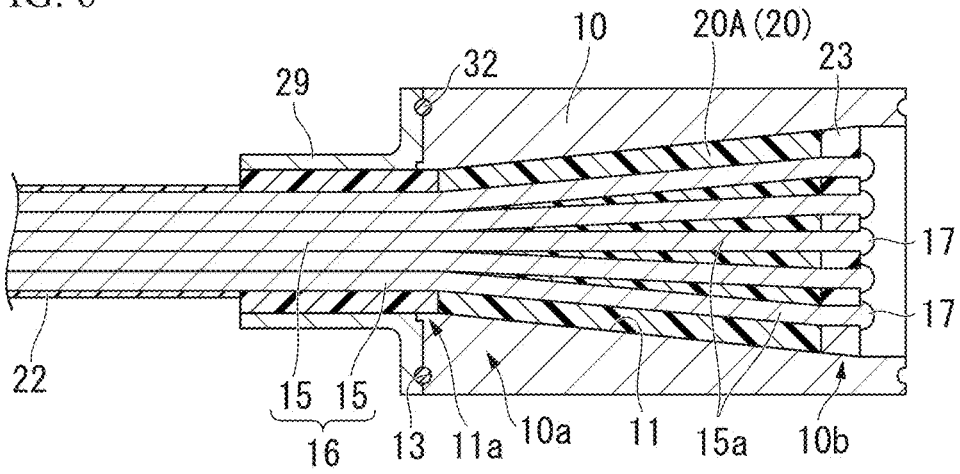
FIG. 6 is a cross-sectional view showing the method for manufacturing a cable of the present embodiment.

As shown in FIG. 6, this mixture 20A is loaded into the tube hole 11 of the socket main body 10. Since the ceramic mass ratio is 7.2 or more, the fluidity of the mixture 20A improves, and the mixture 20A becomes capable of easily flowing into gaps between the inner circumferential surface of the tube hole 11 and the first end portions 15*a* of the steel wires 15 and gaps between the first end portions 15*a* of the steel wires 15 adjacent to each other. The ceramic shots 27 in the mixture 20A which has flown into the above-described gaps adhere to and grip the inner circumferential surface of the tube hole 11 or the first end portions 15*a* of the steel wires 15, and thus, when the mixture 20A is hardened and turns into the first filling material 20 as described below, the steel wires 15 are not easily dropped from the first filling material 20.

Since the fly ash supports the ceramic shots 27, the ceramic shots 27 are uniformly dispersed in the first filling material 20.

Next, in a hardening step S7, the mixture 20A is cast and hardened, thereby turning into the first filling material 20. During the casting of the mixture 20A, since the ceramic shots 27 or the fly ash diffuses the hardening heat of the epoxy resin, the temperature during the casting becomes as low as, for example, approximately 40° C. to 60° C.

Next, in a second filling material-forming step S9, the packing 32 is disposed in the groove portion 13 of the socket main body 10. The ferrule 29 is mounted in the socket main body 10. At this time, the ferrule 29 is aligned by locking the recess portion 30*a* of the ferrule 29 to the protrusion 12 of the socket main body 10.

An epoxy resin which is yet to be hardened is loaded into the ferrule 29. This epoxy resin is cast and hardened, thereby providing the second filling material 21 on the second end portion 15*b* side of the steel wires 15 compared with the first filling material 20 as shown in FIG. 1.

After that, the end portion of the coated tube 22 in the cable main body 16 and the ferrule main body 30 of the ferrule 29 are covered with the tube 33, and the tube 33 is shrunk using heat and is mounted thereon.

The packing 25 is disposed in the groove portion 14 of the socket main body 10. The lid plate 24 is mounted on the socket main body 10.

Meanwhile, the packing 25 and the lid plate 24 can be mounted in the socket main body 10 at any time after the locking step S3.

By the method having the above-described steps, the cable 1 is manufactured.

In the cable 1 constituted and manufactured as described above, since the elastic modulus of the second filling material 21 is smaller than the elastic modulus of the first filling material 20, the concentration of additional stress in the steel wires 15 is relaxed, and fretting between the steel wires 15 is prevented.

EXAMPLES

Hereinafter, examples and comparative examples of the present invention will be specifically described in more detail, but the present invention is not limited to the following examples.

Samples of Comparative Examples 1 to 5 and Examples 1 and 2 shown in Table 1 were produced. Meanwhile, "-" in Table 1 indicates that there are no corresponding values.

Comparative Example 1

An epoxy resin was used as the thermosetting resin, and ceramic shots and fly ash were not added to the mixture. That is, the mixture is only made of the epoxy resin, and a silane coupling agent was added to the mixture in a mass percentage of 2% of the mixture. Since ceramic shots and fly ash were not added to the mixture, the aggregate mass ratio reached zero.

Comparative Example 2

An epoxy resin was used as the thermosetting resin, fly ash was added to the mixture, but ceramic shots were not added to the mixture. The aggregate mass ratio was set to 2.6. A silane coupling agent was added to the mixture in a mass percentage of 2% of the mixture.

Comparative Example 3

An epoxy resin was used as the thermosetting resin, ceramic shots were added to the mixture, but fly ash was not added to the mixture. The aggregate mass ratio was set to 5.7. A silane coupling agent was added to the mixture in a mass percentage of 2% of the mixture.

Comparative Example 4

An epoxy resin was used as the thermosetting resin, ceramic shots were added to the mixture, but fly ash was not added to the mixture. The aggregate mass ratio was set to 2.9. A silane coupling agent was added to the mixture in a mass percentage of 2% of the mixture.

Examples 1 and 2

An epoxy resin was used as the thermosetting resin, ceramic shots and fly ash were mixed together in advance, and furthermore, the epoxy resin was mixed thereinto, thereby producing a mixture. The ceramic mass ratio as set to 7.2, and the aggregate mass ratio was set to 5.5. In Example 1, a silane coupling agent was added to the mixture in a mass percentage of 2% of the mixture, and, in Example 2, a silane coupling agent was added to the mixture in a mass percentage of 4% of the mixture.

Comparative Example 5

A polyester resin was used as the thermosetting resin, and ceramic shots and fly ash were not added to the mixture. That is, the mixture is only made of the polyester resin. Since ceramic shots and fly ash were not added to the mixture, the aggregate mass ratio reached zero.

Evaluation items for evaluating Comparative Examples 1 to 5 and Examples 1 and 2 are the slump amount, the compressive strength, the compressive elastic modulus, the generation temperature during hardening (casting), and the shrinkage during hardening.

Slump Amount:

The slump amount refers to the diameter of the mixture after being deformed due to its own weight in a well-known slump test. Specifically, the mixture was put into a slump cone having an upper base diameter of 50 mm, a lower base diameter of 50 mm, and a height of 50 mm, and, when the slump cone was pulled out, the diameter of the mixture deformed due to its own weight was measured using a scale.

The unit is mm, and the condition for pass is that the mixture is deformed so that the diameter reaches 150 mm or more. As the slump amount increases, the fluidity of the mixture increases.

Compressive Strength and Compressive Elastic Modulus:

The compressive strength was measured using a compressive strength meter after the mixture was hardened. The compressive elastic modulus was measured using a compressive tester and a displacement meter after the mixture was hardened.

The condition for pass of the compressive strength is 100 MPa or more, and the condition for pass of the compressive elastic modulus is 8,000 MPa or more. When the compressive strength and the compressive elastic modulus do not become equal to or more than the above-described values, the well-known effect of the wedge-like first filling material being grasped on the inner circumferential surface of the tube hole of the socket main body is not exhibited when the cable main body is pulled.

Generation Temperature During Hardening (Casting):

The temperature was measured using a thermocouple when the mixture was hardened.

There are cases in which the cable is used with a variety of sensors disposed in the first filling material. In this case, the mixture generates heat during hardening, but the condition for pass of the generation temperature during hardening is approximately 80° C. or lower in order to prevent the sensors from being damaged.

Shrinkage During Hardening:

Whether or not the mixture was shrunk during hardening was confirmed by loading the mixture into the socket and measuring the difference in height between the socket top end and the surface of the filling material.

If the mixture shrinks when the mixture is hardened and turns into the first filling material, gaps are generated among the socket main body, the steel wires, and the first filling material, and there is a problem in that the steel wires are easily dropped from the first filling material.

Therefore, the condition for pass is that the mixture does not shrink during hardening.

The test results of the respective evaluation items and the results of pass/fail are shown in Table 1. Passed mixtures are expressed as "B" or "A". "B" indicates that a mixture satisfies the condition for pass, but does not significantly exceed the condition for pass. "A" indicates that a mixture satisfies the condition for pass and significantly exceeds the condition for pass.

Failed mixtures are expressed as "C".

In order to improve creep resistance, it is important to lower the generation temperature during hardening. However, in order to satisfy the ordinary performance of the cable 1, the mixture also needed to pass the slump amount, the compressive strength, the compressive elastic modulus, and the shrinkage during hardening.

As described above, samples passing all of the evaluation items become a specification for final pass.

In Comparative Example 2, it was found that the slump amount and the compressive strength are evaluated as pass "A" and the generation temperature during hardening and the shrinkage during hardening are evaluated as pass. In Comparative Example 2, it was found that the compressive elastic modulus is evaluated as fail.

In Comparative Example 3, it was found that the generation temperature during hardening and the shrinkage during hardening are evaluated as pass, but the slump amount, the compressive strength, and the compressive elastic modulus are evaluated as fail.

In Comparative Example 4, it was found that the compressive strength, the compressive elastic modulus, the generation temperature during hardening, and the shrinkage during hardening are evaluated as pass, but the slump amount is evaluated as fail.

In Examples 1 and 2, it was found that the compressive strength and the compressive elastic modulus are evaluated as pass "A" and the slump amount, the generation temperature during hardening, and the shrinkage during hardening are evaluated as pass.

In Comparative Example 5, the mixture is made of the polyester resin. Therefore, the slump amount becomes too great to be measured and is evaluated as pass "A". In Comparative Example 5, it was found that the compressive strength, the compressive elastic modulus, the generation temperature during hardening, and the shrinkage during hardening are evaluated as fail.

From the above-described results, it was found that Examples 1 and 2 have the specification for final pass.

Figure 7:
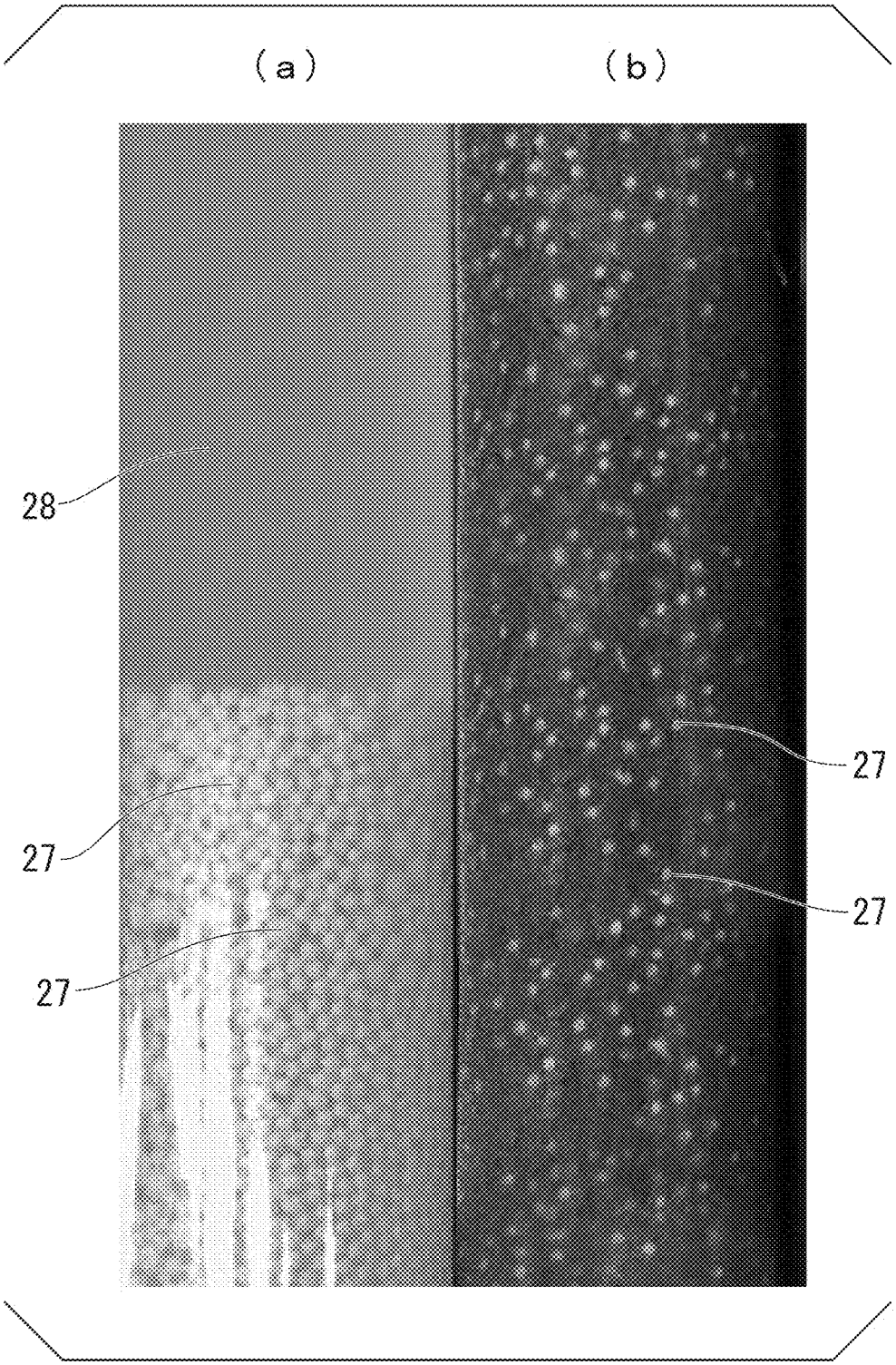
FIG. 7 is a photograph showing a case (a) in which a test tube is filled with ceramic shots and an epoxy resin after being mixed together and a case (b) in which ceramic shots and fly ash are mixed together in a test tube and then an epoxy resin is mixed thereinto.

Meanwhile, a photograph of test results obtained from Comparative Example 3 and Examples 1 and 2 is shown in FIG. 7.

(a) in FIG. 7 shows a state in which, as a comparative example, the ceramic shots 27 and an epoxy resin 28 are mixed together first and are then loaded into a transparent test tube. It was found that the ceramic shots 27 are deposited and the ceramic shots 27 and the epoxy resin 28 are separated from each other.

(b) in FIG. 7 shows a state in which, as in the present embodiment, the ceramic shots 27 and fly ash are mixed together in a transparent test tube and furthermore an epoxy resin is mixed thereinto. Since steel wires were not disposed

TABLE 1

| | | Condition for pass | Comparative Example 1 | Comparative Example 2 | Comparative Example 3 | Comparative Example 4 | Example 1 | Example 2 | Comparative Example 5 |
|---|---|---|---|---|---|---|---|---|---|
| Blending ratio | Ceramic shot | — | — | — | 100 | 100 | 87.75 | 87.75 | — |
| | Fly ash | — | — | 100 | — | — | 12.25 | 12.25 | — |
| Ceramic mass ratio | | — | — | — | — | — | 7.2 | 7.2 | — |
| Thermosetting resin used | | — | Epoxy resin | Epoxy resin | Epoxy resin | Epoxy resin | Epoxy resin | Epoxy resin | Polyester resin |
| Aggregate mass ratio | | — | 0 | 2.6 | 5.7 | 2.9 | 5.5 | 5.5 | 0 |
| Silane coupling agent | | — | 2% | 2% | 2% | 2% | 2% | 4% | — |
| Evaluation item | Slump amount (mm) | 150 mm or more | — A | 185 A | 110 C | 115 C | 150 B | 150 B | — A |
| | Compressive strength (MPa) | 100 MPa or more | 104 B | 122.6 A | 88.7 C | 101.7 B | 128.1 A | 127.5 A | 72.0 C |
| | Compressive elastic modulus (MPa) | 8,000 MPa or more | 2,788 C | 7,418 C | 7,191 C | 8,716 B | 9,133 A | 10,226 A | 4,733 C |
| | Generation temperature during hardening (° C.) | Approximately 80° C. or lower | 100° C. C | 60° C. B | 40° C. B | 50° C. B | 40° C. B | 40° C. B | 100° C. C |
| | Shrinkage during hardening | No shrink | Shrink C | No shrink B | No shrink B | No shrink B | No shrink B | No shrink B | Shrink C |

In Comparative Example 1, the mixture is made up of the epoxy resin and the silane coupling agent. Therefore, the slump amount becomes too great to be measured and is evaluated as pass "A". The compressive strength was also evaluated as pass, but it was found that the compressive elastic modulus, the generation temperature during hardening, and the shrinkage during hardening are evaluated as fail.

in the test tube, the constitution is different from that of the cable of the present embodiment, but becomes the same as the constitution of the first filling material of the present embodiment. It was found that, in this case, the ceramic shots 27 are not deposited and the ceramic shots 27 are uniformly mixed together in the test tube.

As described above, according to the cable 1 and the method for manufacturing the cable 1 of the present embodiment, since the hardening heat of the epoxy resin 28 is absorbed and diffused by the preliminary mixture obtained by mixing the ceramic shots 27 and fly ash, the hardening temperature during casting becomes low. In addition, the ceramic shots 27 and fly ash are not metallic materials and are thus not easily corroded by seawater or the like. Therefore, it is possible to improve corrosion resistance when the cable 1 of the present embodiment and the cable 1 manufactured using the method for manufacturing the cable 1 of the present embodiment are immersed in water.

Since the first filling material 20 includes the ceramic shots 27, the compressive elastic modulus of the first filling material 20 becomes high, and the creep resistance improves. Therefore, it is possible to prevent the deformation of the first filling material 20 which is a socket casting material.

Since the ceramic shots 27 are uniformly dispersed in the socket main body 10, the properties of the first filling material 20 are stable regardless of the location of the first filling material 20, and the ceramic shots 27 adhere to and grip the inner circumferential surface of the tube hole 11 or the first end portions 15*a* of the steel wires 15.

Since the first filling material 20 includes the silane coupling agent, it is possible to improve adhesiveness among the ceramic shots 27 which are an inorganic material, the fly ash, and the epoxy resin.

In the method for manufacturing the present cable 1, since the wire rod insertion step S1 and the locking step S3 are carried out before the filling step S5, the first end portions 15*a* of the steel wires 15 are separated from the inner circumferential surface of the tube hole 11 of the socket main body 10. Therefore, it is possible to uniformly load the ceramic shots 27 between the inner circumferential surface of the tube hole 11 of the socket main body 10 and the first end portions 15*a* of the steel wires 15.

The second filling material 21 is provided on the second end portion 15*b* side of the steel wires 15 compared with the first filling material 20. Since the second filling material 21 having a small elastic modulus is provided in a portion in which the curvature radius of the cable main body 16 becomes small when the cable main body 16 is bent, the concentration of additional stress is relaxed, and fretting is prevented. Therefore, the bending stress of the steel wire 15 becomes uniform, and thus it is possible to improve the fatigue resistance of the steel wire 15.

It is possible to reliably load the mixture 20A into gaps between the socket main body 10 and the steel wires 15 by setting the ceramic mass ratio to 7.2 or more so as to improve the fluidity of the mixture 20A.

Since the aggregate mass ratio is 5 or more, it is possible to prevent the separation of the ceramic shots 27, the fly ash, and the epoxy resin which are mixed together.

Hitherto, an embodiment of the present invention has been described in detail with reference to the accompanying drawings, but the specific constitution is not limited to this embodiment, and constitutions within the scope of the gist of the present invention may be modified, combined, removed, or the like.

For example, in the above-described embodiment, the second filling material 21 may not be provided in the cable 1. That is, in the method for manufacturing the cable 1, the second filling material-forming step S9 may not be carried out.

As the thermosetting resin, the epoxy resin was used. However, the thermosetting resin is not limited to the epoxy resin and may be a polyester resin or the like.

The cable 1 of the present embodiment can be used for sea applications; however, additionally, can also be used for bridge applications.

REFERENCE SIGNS LIST

1 cable
10 socket main body
10*a* first end portion
11 tube hole
15 steel wire (wire rod)
17 button head (expanded diameter portion)
20 first filling material (filling material)
20A mixture
21 second filling material
23 fastening plate (fixation plate)
23*a* through hole
27 ceramic shot (ceramic particle)
S1 wire rod insertion step
S3 locking step
S5 filling step

What is claimed is:

1. A method for manufacturing a cable, comprising:

a filling step of filling a tube hole of a socket main body which is formed in a tubular shape and in which first end portions of wire rods are disposed with a mixture obtained by mixing a thermosetting resin into a preliminary mixture obtained by mixing ceramic particles and fly ash in advance, wherein the ceramic particles are formed in non-fibrous particles.

2. The method for manufacturing a cable according to claim 1, further comprising, before the filling step:

a wire rod insertion step of respectively inserting first end portions of the wire rods into the tube hole of the socket main body and through holes formed in a fixation plate; and a locking step of locking expanded diameter portions provided at first end portions of the wire rods to edge portions of the through holes in the fixation plate and separating first end portions of the wire rods from an inner circumferential surface of the tube hole.

3. The method for manufacturing a cable according to claim 1, wherein, after the filling step, the mixture is hardened so as to produce a filling material, and a second filling material having an elastic modulus that is smaller than an elastic modulus of the filling material is provided on the second end portion side of the wire rods compared with the filling material.

4. The method for manufacturing a cable according to claim 1, wherein the thermosetting resin is an epoxy resin.

5. The method for manufacturing a cable according to claim 1, wherein a ratio of a mass of the ceramic particles to a mass of the fly ash, which are mixed together in the filling step, is 7.0 or more.

6. The method for manufacturing a cable according to claim 1, wherein a ratio of a sum of the mass of the fly ash and the mass of the ceramic particles to a mass of the thermosetting resin, which are mixed together in the filling step, is 5 or more.

7. A cable comprising:

a socket main body formed in a tubular shape;

wire rods having a first end portion disposed in a tube hole of the socket main body; and a filling material which is loaded into the tube hole of the socket main body and is hardened after being mixed with ceramic particles, fly ash, and a thermosetting resin, wherein the ceramic particles are formed in non-fibrous particles.

8. The method for manufacturing a cable according to claim 1, wherein a ratio of a mass of the ceramic particles to a mass of the fly ash, which are mixed together in the filling step, is 7.2 or more.

* * * * *